US006296308B1

(12) United States Patent
Cosentino et al.

(10) Patent No.: US 6,296,308 B1
(45) Date of Patent: Oct. 2, 2001

(54) SHAPE ADJUSTING MECHANISM

(75) Inventors: Christopher Cosentino, Bolton; Tony Maier, Aurora; Jack Rietveld, Burlington, all of (CA)

(73) Assignee: Schukra Manufacturing Inc., Etobicoke (CA)

( * ) Notice: Subject to any disclaimer, the term of this patent is extended or adjusted under 35 U.S.C. 154(b) by 0 days.

(21) Appl. No.: 09/501,771

(22) Filed: Feb. 10, 2000

(51) Int. Cl.[7] ..... B60N 2/66
(52) U.S. Cl. ..... 297/284.4
(58) Field of Search ..... 297/284.4, 284.1, 297/284.7

(56) References Cited

U.S. PATENT DOCUMENTS

| | | | |
|---|---|---|---|
| 1,743,377 | 1/1930 | Nadell . | |
| 3,378,299 | 4/1968 | Sandor | 297/284 |
| 3,762,769 | 10/1973 | Poschl | 297/284 |
| 4,153,293 | 5/1979 | Sheldon | 297/284 |
| 4,313,637 | 2/1982 | Barley | 297/284 |
| 4,316,631 | 2/1982 | Lenz | 297/284 |
| 4,354,709 | 10/1982 | Schuster | 297/284 |
| 4,359,245 | 11/1982 | Franke | 297/284 |
| 4,601,514 | 7/1986 | Meiller | 297/284 |
| 4,627,661 | 12/1986 | Ronnhult | 297/284 |
| 4,632,454 | 12/1986 | Naert | 297/284 |
| 4,650,247 | 3/1987 | Berg | 297/284 |
| 4,676,550 | 6/1987 | Neve De Mevergnies | 297/284 |
| 4,880,271 | 11/1989 | Graves | 257/284 |
| 4,909,568 | 3/1990 | Dal Monte | 297/284 |
| 4,968,093 | 11/1990 | Dal Monte | 297/284 |
| 5,026,116 | 6/1991 | Dal Monte | 297/284 |
| 5,050,930 | 9/1991 | Schuster | 257/284 |
| 5,197,780 | 3/1993 | Coughlin | 297/284.7 |
| 5,217,278 | 6/1993 | Harrison | 297/284 |
| 5,335,965 | 8/1994 | Sessini | 297/284 |
| 5,385,531 | 1/1995 | Jover | 601/99 |
| 5,397,164 | 3/1995 | Schuster | 297/284 |
| 5,518,294 | 5/1996 | Ligon, Sr. | 297/284 |
| 5,553,917 | 9/1996 | Adat | 297/230.14 |
| 5,626,390 | 5/1997 | Schuster | 297/284 |
| 5,651,583 * | 7/1997 | Klingler et al. | 297/284.4 |
| 5,762,397 | 6/1998 | Venuto | 297/284 |
| 5,775,773 | 7/1998 | Schuster | 297/284.1 |
| 6,036,265 * | 3/2000 | Cosentino | 297/284.4 |

FOREIGN PATENT DOCUMENTS

| | | | |
|---|---|---|---|
| 2181776 | 1/1998 | (CA) . | |
| 2040794 | 8/1970 | (DE) | 297/284.4 |
| 2345254 | 4/1974 | (DE) . | |
| 2804-703 | 8/1979 | (DE) | 297/284.4 |
| 0 322 535 A1 | 10/1988 | (EP) . | |
| 2013487 | 8/1979 | (GB) | A47C/7/46 |
| 0587924 | 1/1978 | (SU) | 297/284.4 |

* cited by examiner

*Primary Examiner*—Peter R. Brown
(74) *Attorney, Agent, or Firm*—Bereskin & Parr

(57) ABSTRACT

A shape adjusting mechanism is provided having a basket that is flexed on a guide track by a cable mechanism. The basket comprises an elongate resilient plate in which is defined at least one slot. The slot has at least one reinforcing flange that defines a region of high bending resistance relative to a controlled arch region in the plate in order that the flex of the plate in the controlled region will be more pronounced than in the region with the slot. A reinforcing edge flange is also provided along at least a portion of the longitudinal edge of the plate. In a further embodiment a plurality of crossforms are define transversely in the controlled arch region to predefine an arch in the plate while the plate is in a rest state.

14 Claims, 16 Drawing Sheets

SHAPE ADJUSTING MECHANISM

FIELD OF THE INVENTION

The invention relates generally to mechanisms for adjusting the shape of a back rest, and more particulary to baskets for such mechanisms which conform more closely to the curvature of the human spine.

BACKGROUND OF THE INVENTION

Shape adjusting mechanisms for back rests are well known. Such mechanisms typically include a shaping element, also referred to as a panel or "lumbar basket", which is mounted for displacement along a guide track. The lumbar basket may have various configurations. A basic construction involves a pair of brackets displaceable along an axis of the guide track, resilient axial ribs joining the brackets and resilient transverse ribs fixed centrally to the axial ribs with free ends extending laterally to either side of the axial ribs to provide a cushioning effect. Various mechanisms can be used to draw the brackets together in order to flex the lumbar basket from a relatively flat rest state to various bowed states. Various mechanisms can also be used to displace the lumbar basket axially along the track. Thus, the curvature of the lumbar basket and its position within a back rest can be adjusted to provide greater comfort.

The basic lumber basket described above has a flexed profile which is essentially a segment of a circle, and consequently does not conform adequately to the curvature of a user's spine. One prior art approach to altering the basic flexed profile involves fixing a partial central rib to an upper bracket and an upper set of the transverse ribs, making the upper end of the basket more rigid. This induces greater flexing of the basket proximate to the lower bracket, providing greater comfort for many users. There are, however, shortcomings to such an approach. Making the partial rib and then fastening it to multiple components of the basic lumbar basket contributes to cost. There is also little freedom to specify the profile ultimately presented by the lumbar basket.

Another approach to altering the basic flexed profile involves stamping each axial rib with reinforcing flanges that extend partially along the length of the rib and produce lengthwise rib sections of different bending resistance that determine the profile of the lumbar basket in its flexed state. This approach provides advantages including reduced manufacturing costs over the above described approach. Despite these advantages there is a continuing need for further reductions in manufacturing costs for the lumbar basket as well as a continuing need to improve the operation and weight characteristics of the lumbar basket.

Another problem with conventional lumbar basket designs is that they may flex in the opposite direction than desired when moved from a rest state to a flexed state. This may pose a safety hazard or at the very least an annoyance to consumers if the basket suddenly snaps from the opposite flexed state. It is desirable that a lumber basket be developed that will not flex in an opposite direction.

BRIEF SUMMARY OF THE INVENTION

In one aspect, the invention provides a basket for a shape adjusting mechanism comprising:

at least one elongate resilient plate having at least one elongate slot defined along a portion of the longitudinal axis of said plate; and at least one reinforcing flange defined along at least one longitudinal side of said at least one slot to define a region of high bending resistance relative to a controlled arch region in said plate in order that the flex of said plate in said controlled arch region will be more pronounced than in the region with said slot.

In another aspect, the invention provides a shape adjusting mechanism comprising:

a pair of support brackets spaced apart along a predetermined axis;

at least one elongate resilient plate having one end fixed to one of said support brackets and an opposite end fixed to the other of said support brackets such that said plate flexes in a predetermined direction as said support brackets are displaced axially towards one another;

at least one elongate slot defined along a portion of the longitudinal axis of said plate, said slot having at least one reinforcing flange defined along at least one longitudinal side of said slot to define a region of high bending resistance relative to a controlled arch region in said plate in order that the flex of said plate in said controlled arch region will be more pronounced than in the region with said slot; and means operable to displace said support brackets axially relative to one another thereby to flex said plate.

Other aspects of the invention will be apparent from a description below of preferred embodiments and will be more specifically defined in the appended claims.

DETAILED DESCRIPTION OF THE DRAWINGS

The invention will be better understood with reference to the drawings in which.

DETAILED DESCRIPTION OF PREFERRED EMBODIMENTS

Figure 1:
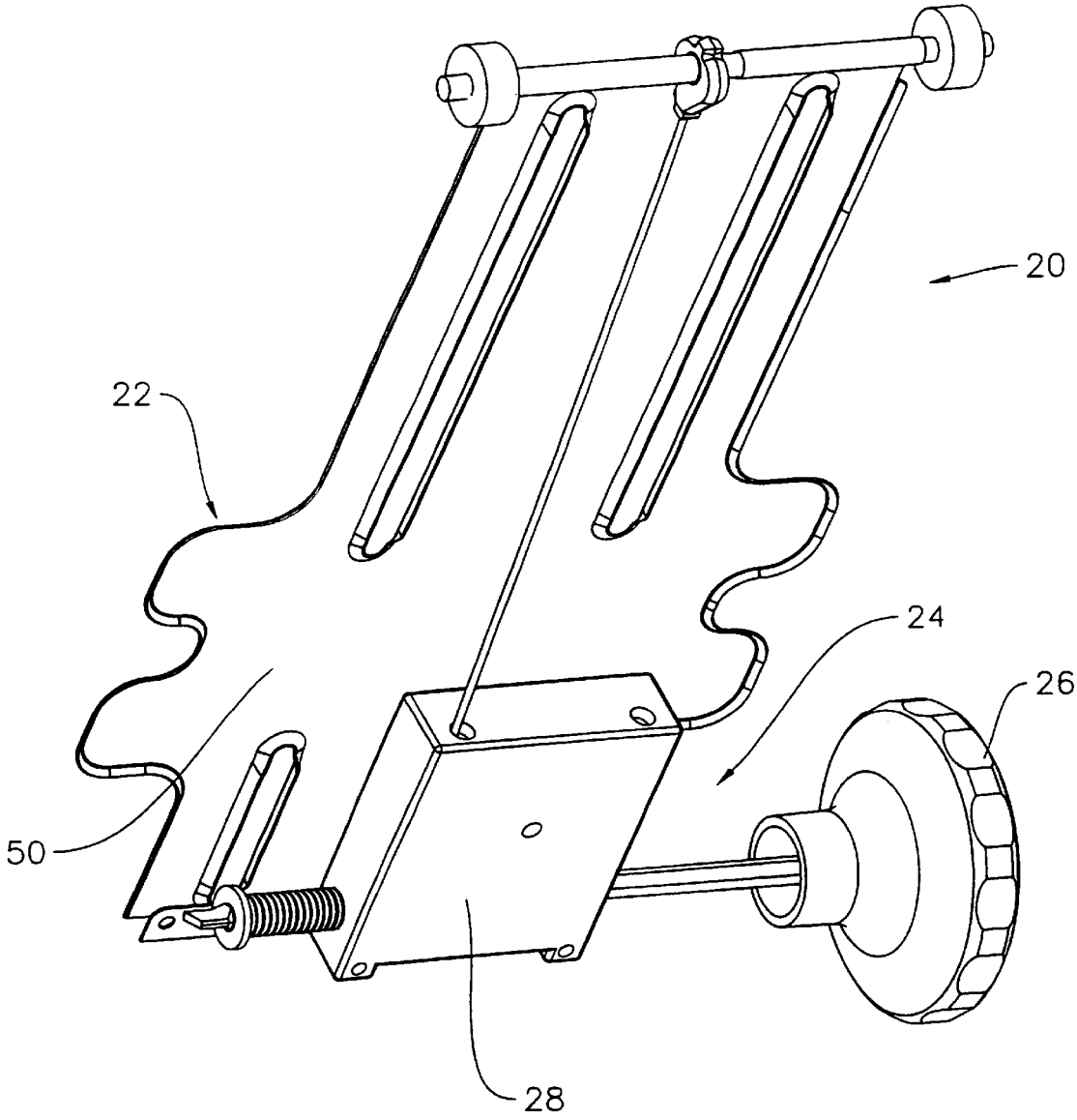
FIG. 1 is a rear perspective view of a shape adjusting mechanism in accordance with the present invention.
Figure 2:
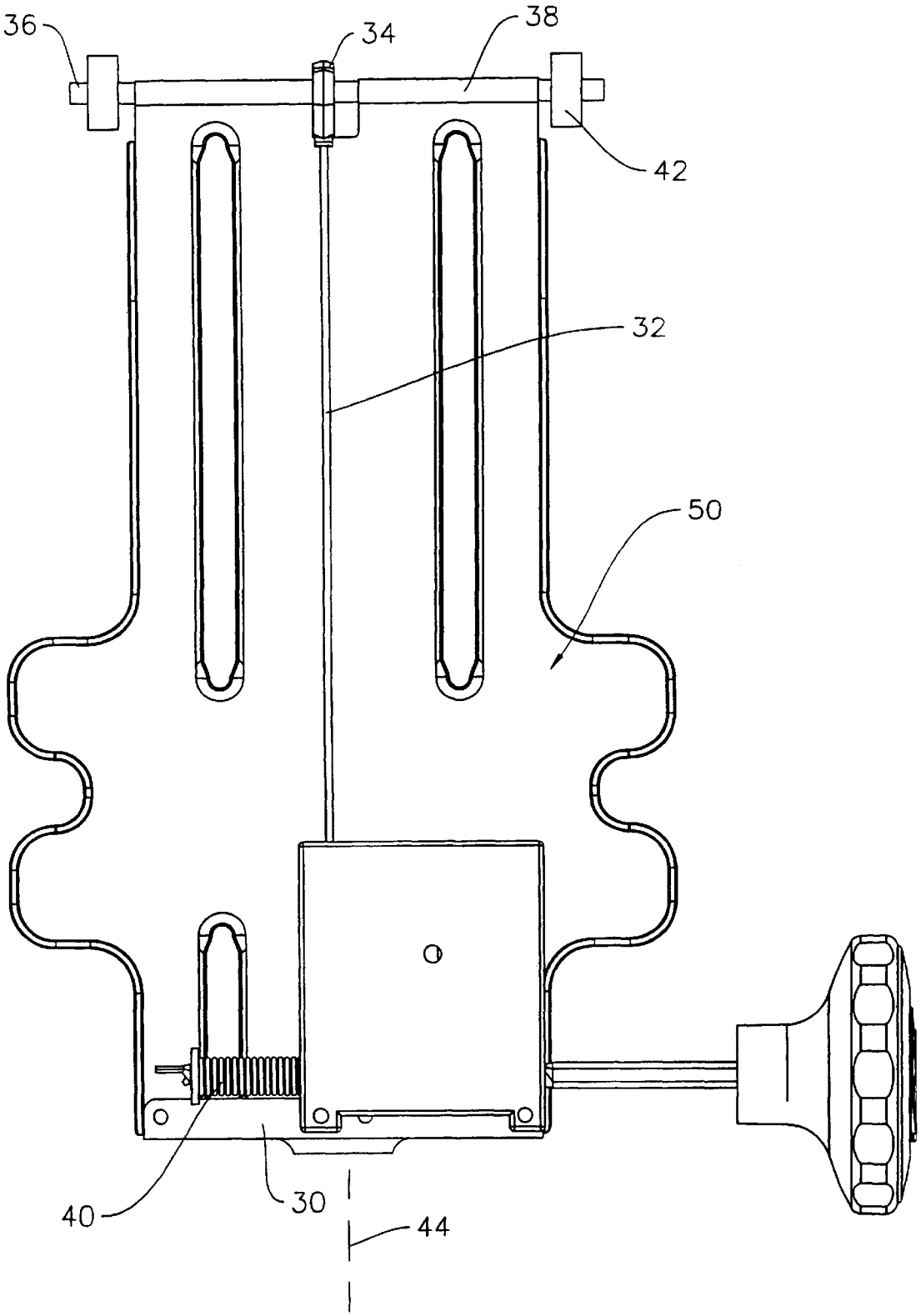
FIG. 2 is a rear view of the mechanism of FIG. 1.
Figure 3:
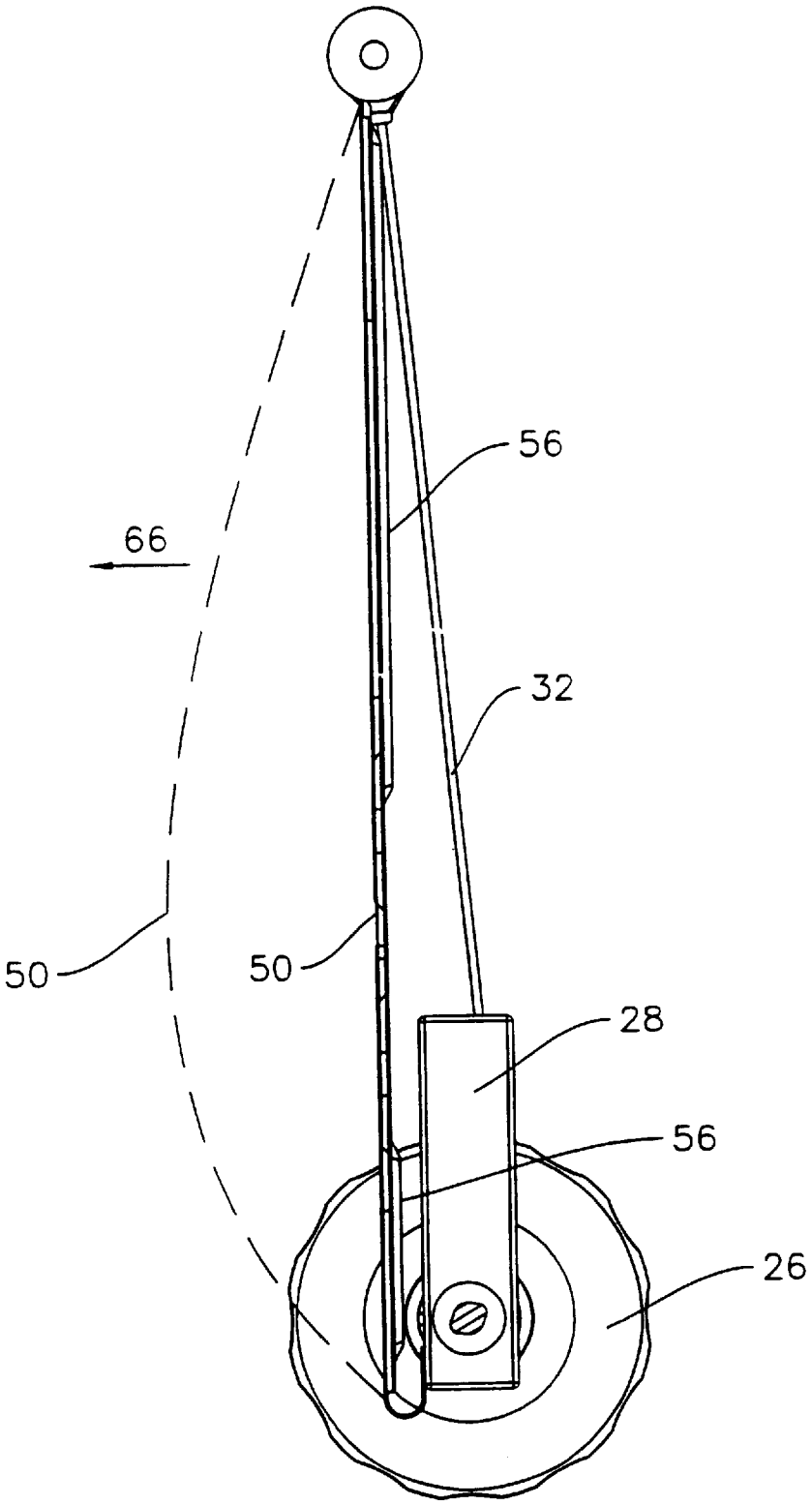
FIG. 3 is a right side view of the mechanism of FIG. 1.
Figure 4:
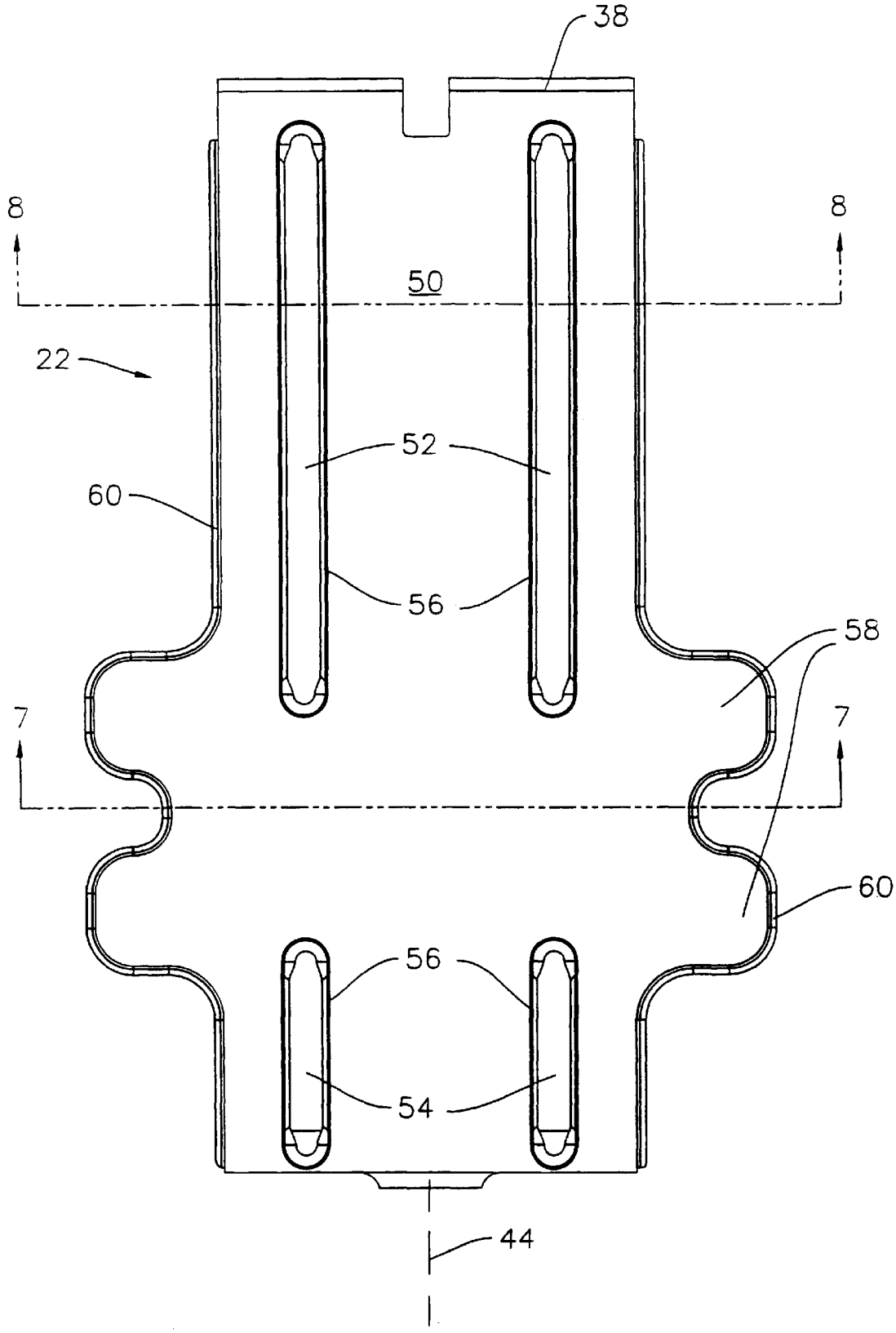
FIG. 4 is a front view of a basket for the mechanism of FIG. 1.
Figure 5:
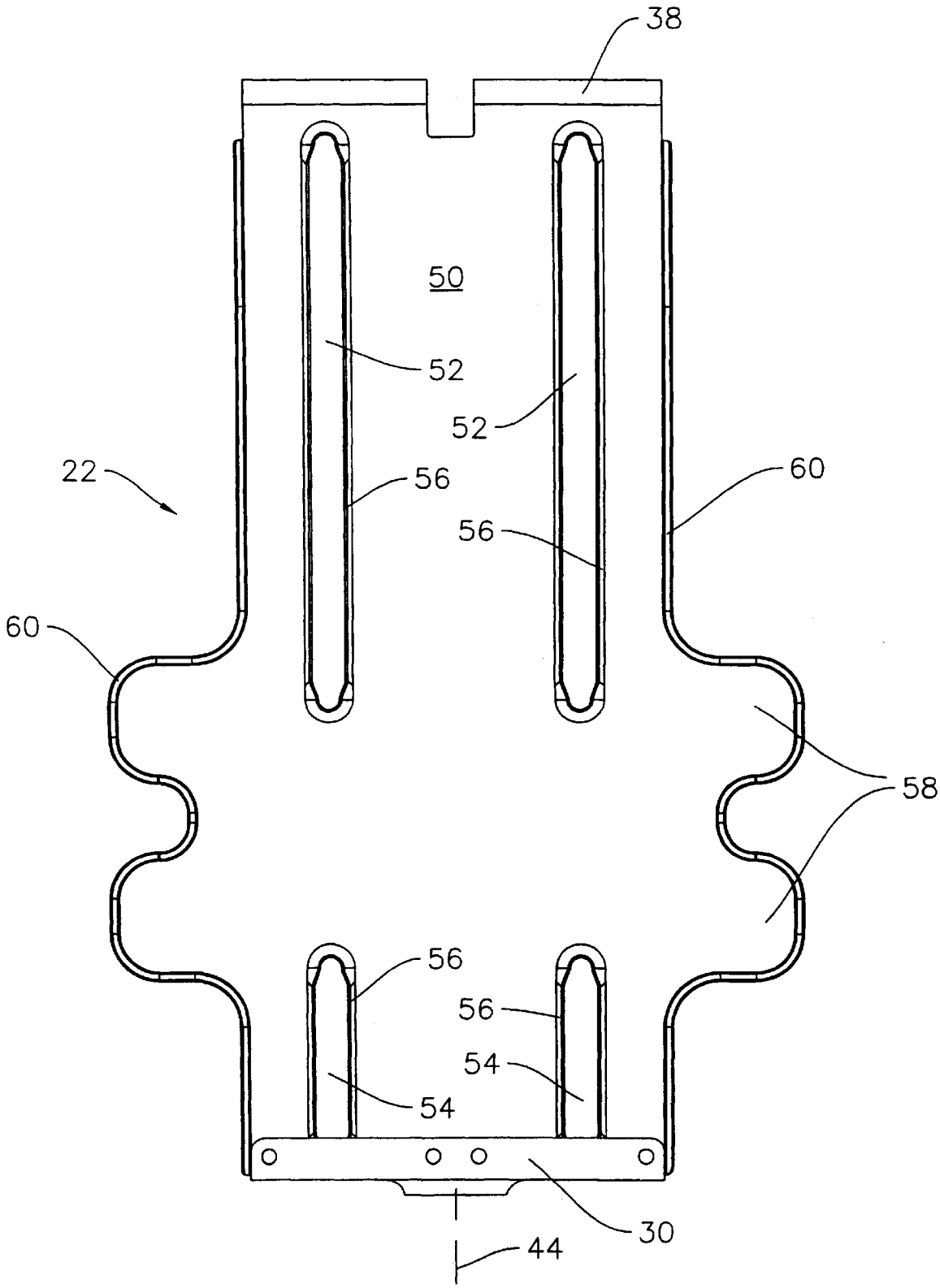
FIG. 5 is a rear view of the basket of FIG. 4.
Figure 6:
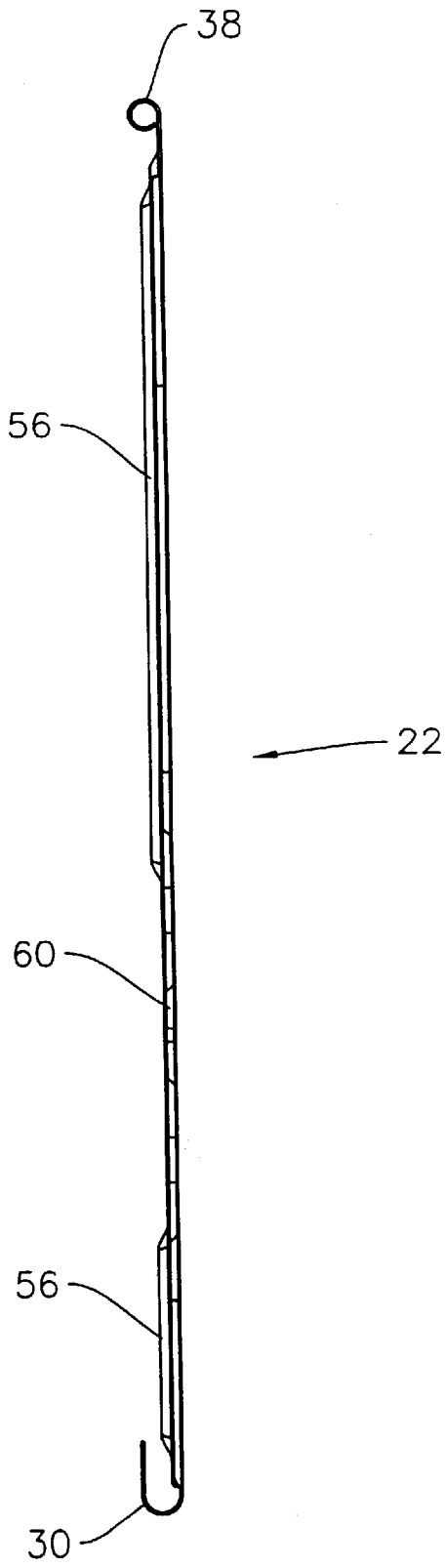
FIG. 6 is a right side view of the basket of FIG. 4.
Figure 7:
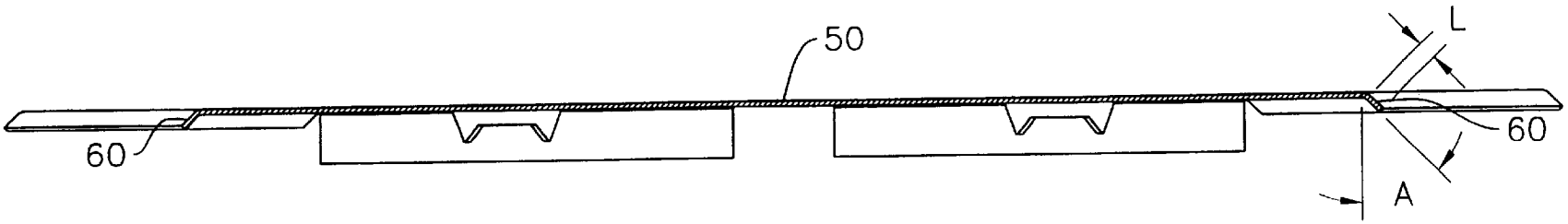
FIG. 7 is a transverse sectional view of the basket of FIG. 4 taken alo lines 7—7.

Referring to FIGS. 1 to 8, a first embodiment of a shape adjusting mechanism in accordance with the present invention is shown generally at 20.

The mechanism 20 includes a resilient basket 22 and a cable mechanism 24. The cable mechanism 24 has any suitable construction as is well known in the art for flexing a basket. The depicted cable mechanism 24 has a rotatable knob 26 that is operably connected to a lock plate assembly 28. The lock plate assembly 28 is mounted with rivets to a lower support bracket 30 located on the basket 22. A cable 32 extends from a spool (not shown) in the lock plate assembly 28 and attaches by means of a ring 34 to a pin 36 that extends through an upper support bracket 38 located on the basket 22. The spool is tensioned by a spring 40 that is mounted to the lower support bracket 30.

A pair of rollers 42 are disposed on each end of the pin 36 for travelling along an axis 44 in a guide track (not shown) that would be disposed in a back rest (not shown). The guide track can be mounted to a common support structure insertable into the back rest or separately mounted within the back rest, as has been done in the prior art.

The knob 26 can be rotated in one direction to draw the cable 32 onto the spool in the lock plate assembly 28 thus displacing the upper and lower support brackets 38, 30 axially towards one another and flex the basket 22. The knob can be rotated in an opposite direction to release the cable 32 allowing the brackets 38, 30 to separate under the resilience of the basket 22. As well, a mechanism (not shown) will typically be provided to displace the brackets 38, 30 together along the guide track for purposes of positioning the basket 22.

Referring more particularly to the basket 22 as shown in FIGS. 4 to 8, the basket is formed as a one piece plate 50 that is cut from a resiliently flexible lightweight and thin material such as spring steel (e.g. MARTENSITE™).

Figure 8:
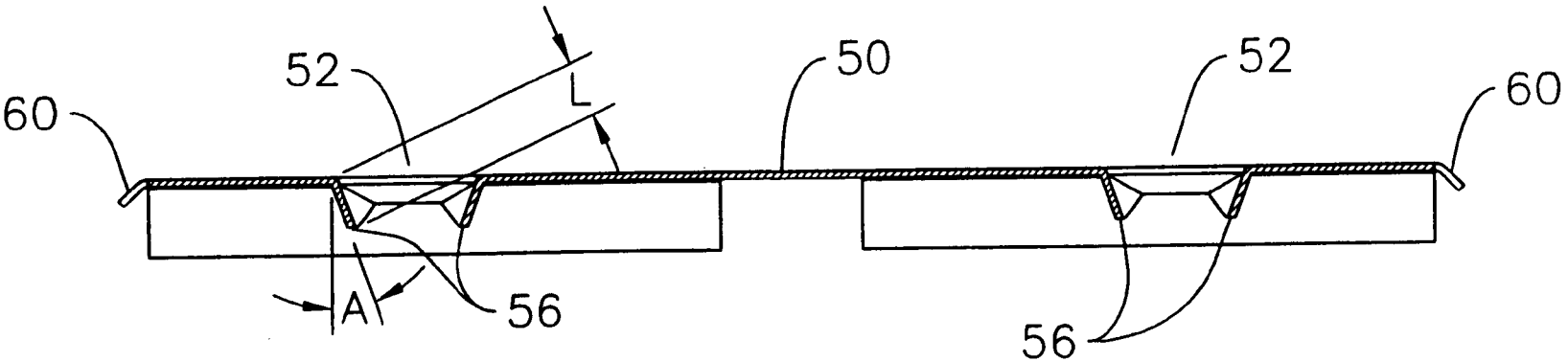
FIG. 8 is a transverse sectional view of the basket of FIG. 4 taken along lines 8—8.
Figure 9:
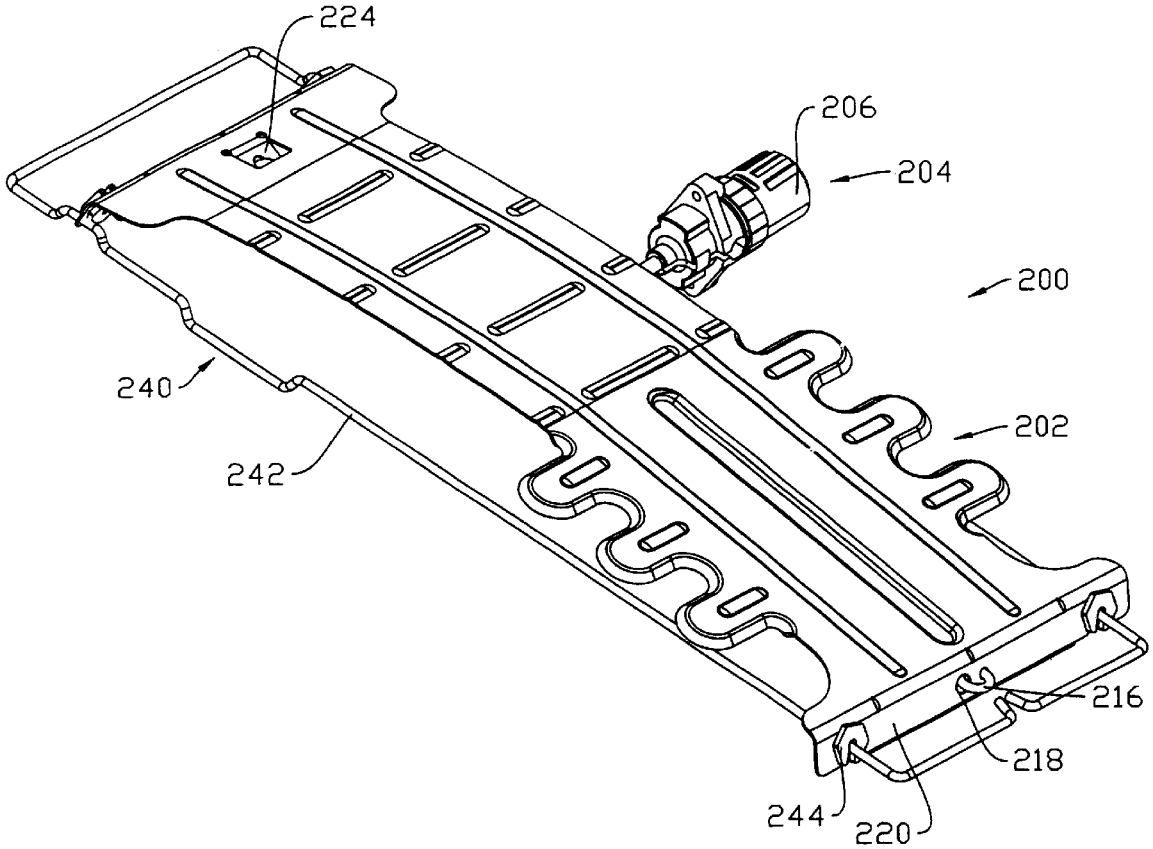
FIG. 9 is a front perspective view of a second embodiment of shape adjusting mechanism in accordance with the present invention.
Figure 10:
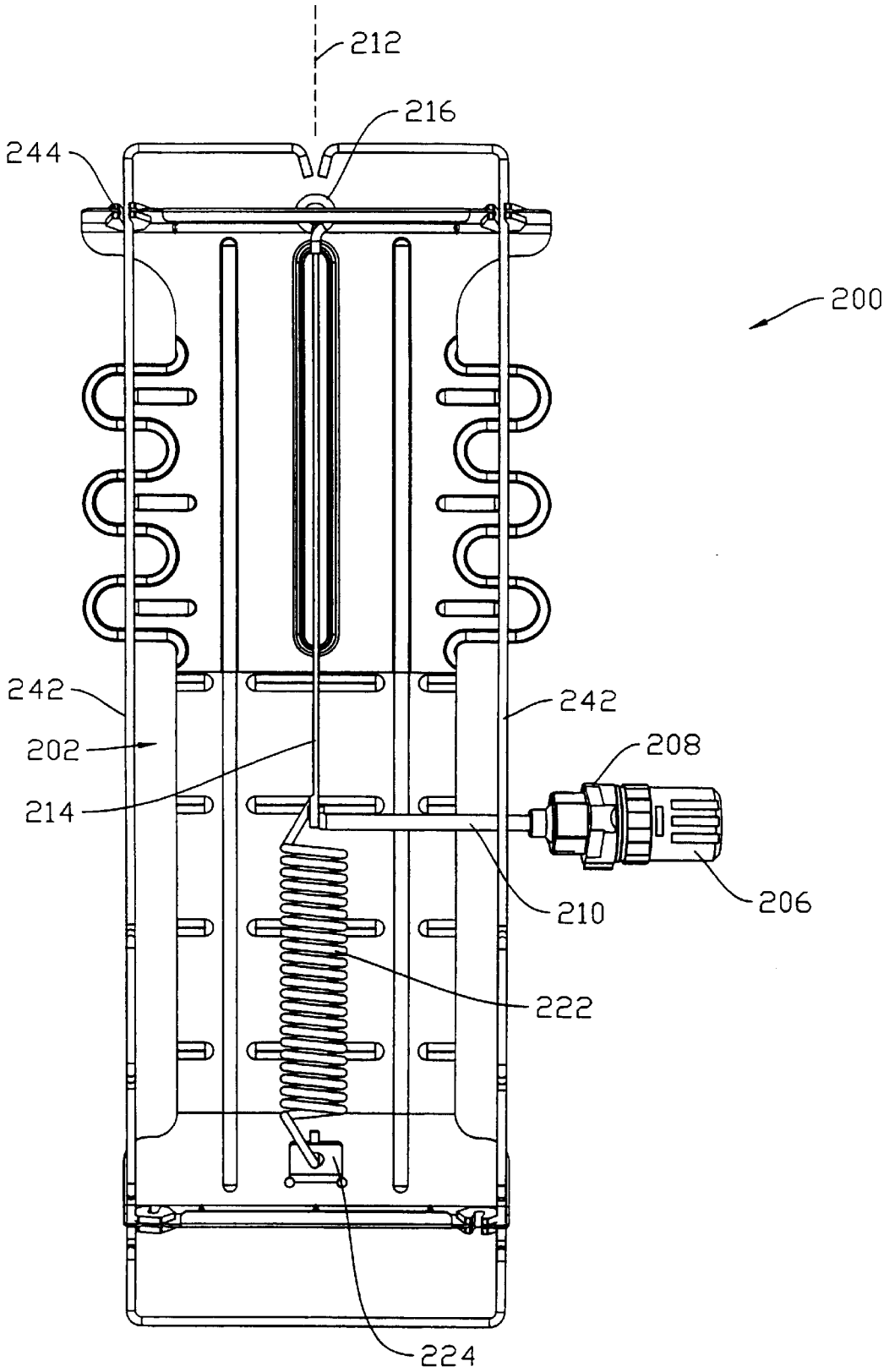
FIG. 10 is a rear view of the mechanism of FIG. 9.
Figure 11:
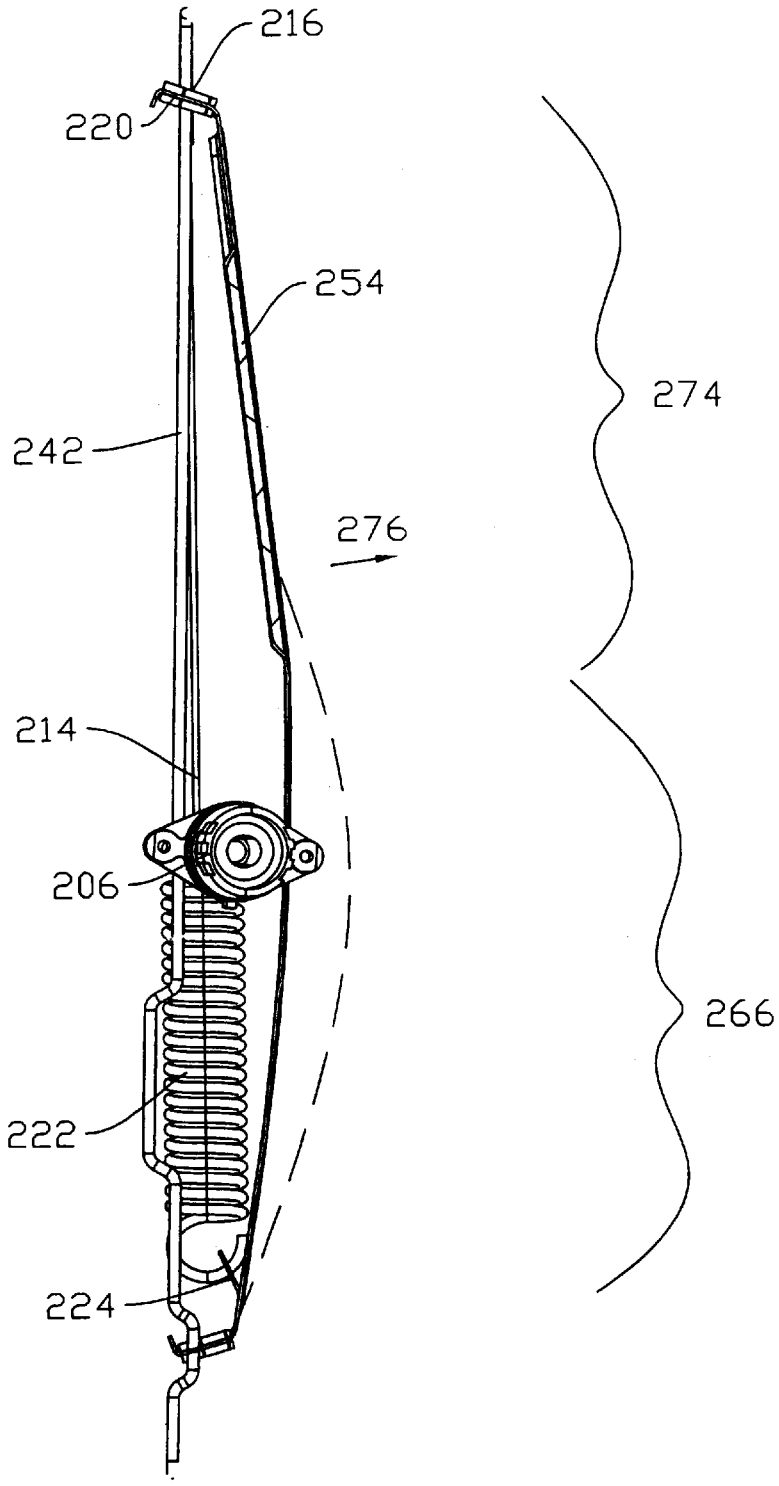
FIG. 11 is a right side view of the mechanism of FIG. 9.
Figure 12:
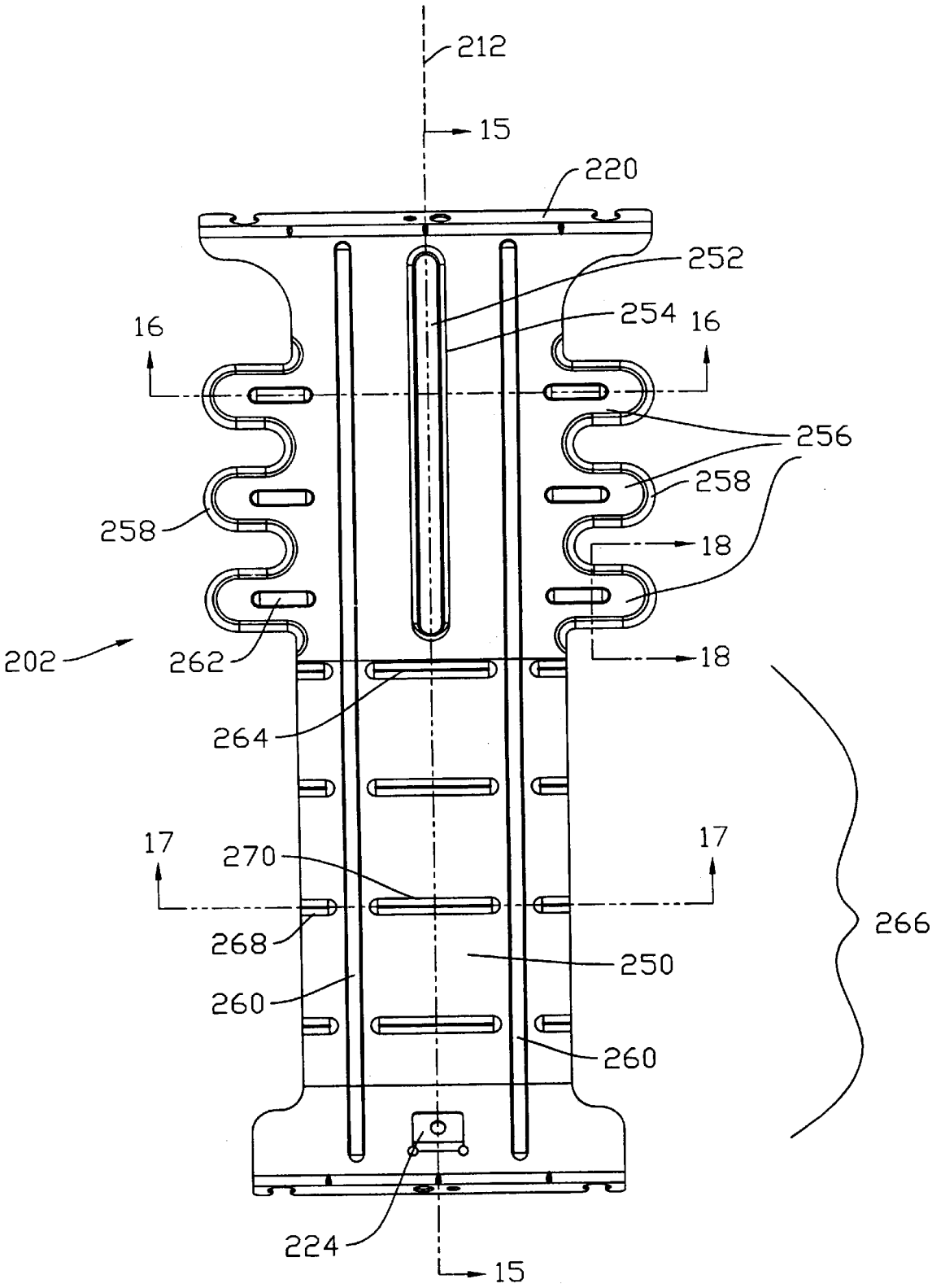
FIG. 12 is a front view of a basket for the mechanism of FIG. 9.
Figure 13:
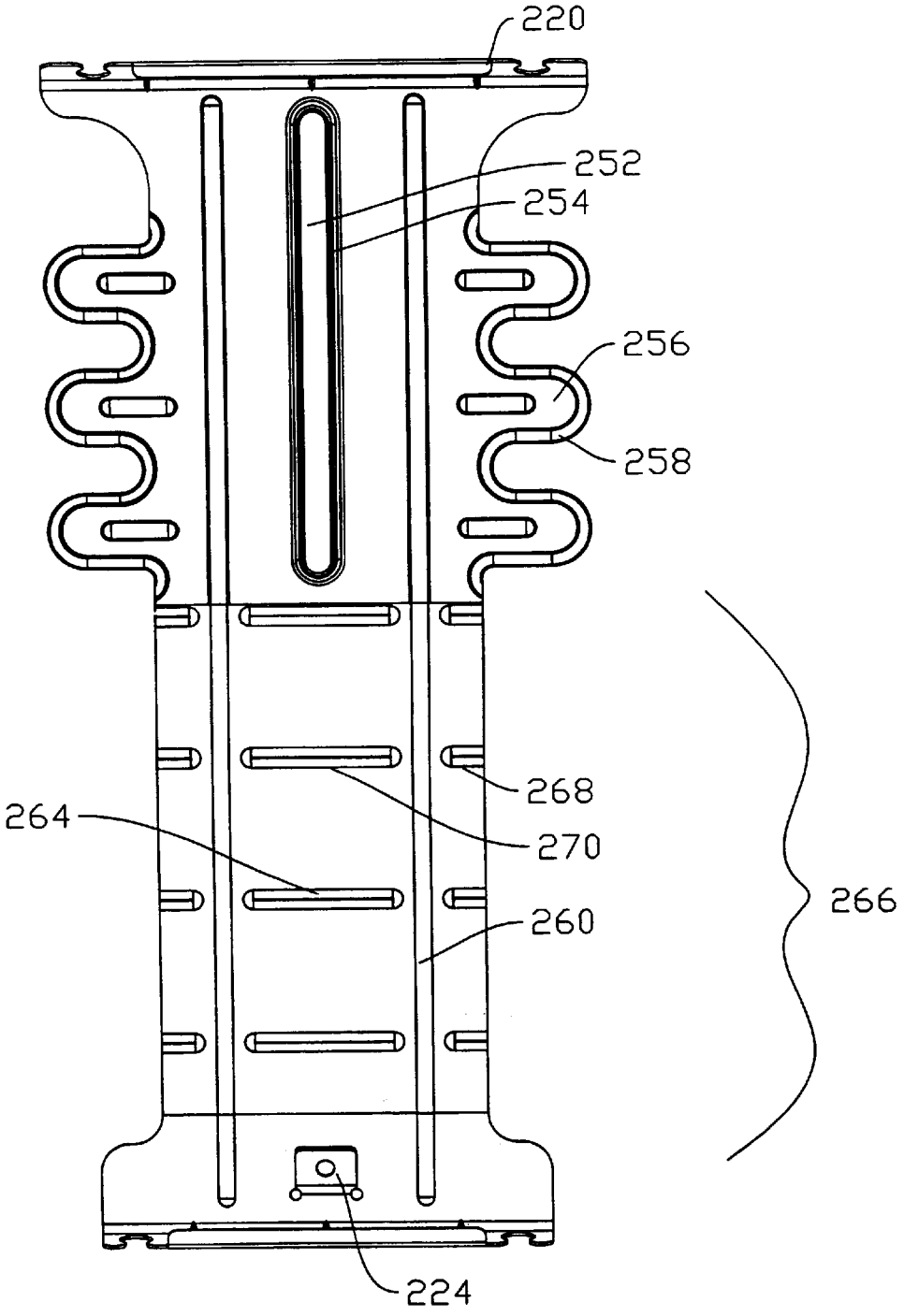
FIG. 13 is a rear view of the basket of FIG. 12.
Figure 14:
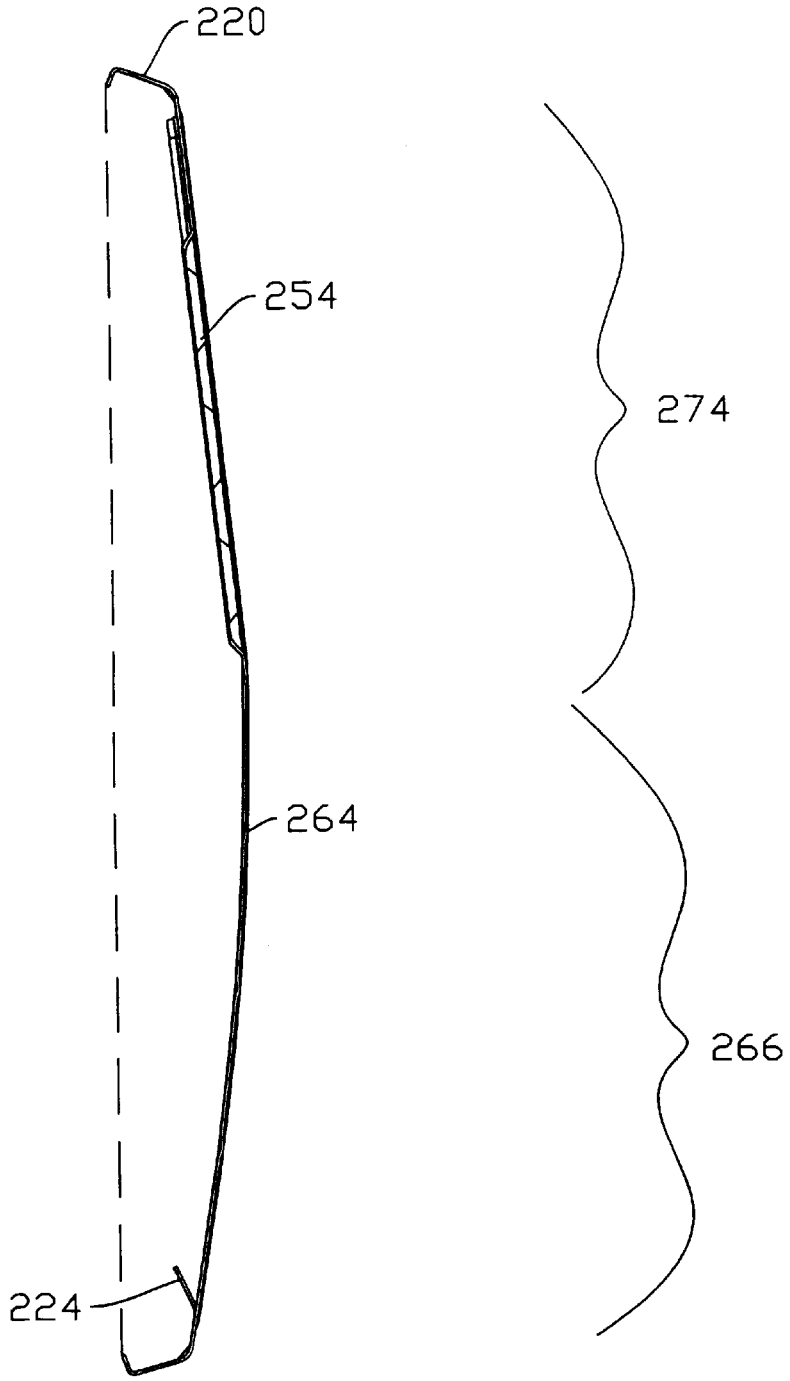
FIG. 14 is a right side view of the basket of FIG. 12.

A pair of parallel spaced upper slots 52 and a pair of parallel spaced lower slots 54 are defined in the plate such that the slots are parallel to and equally spaced laterally from axis 44. Each of the upper and lower slots 52, 54 has rearwardly extending flanges 56 that act to reinforce each of the slots 52, 54 against bending along axis 44. Two parallel flanges 56 are shown but it will be understood that the slots 52, 54 may each be defined with a single flange 56. The slot flanges 56 are preferably inclined towards the centre of the slots 52, 54 as shown in FIG. 8.

The basket 22 further includes transverse ribs 58 that are integrally formed with the plate 50 and which extend laterally outwardly relative to the upper and lower slots 52, 54.

A flange 60 is defined along each of the longitudinal edges of the basket 22 to provide some resistance against bending along axis 44. The bending resistance provided by the edge flanges 60 is less than the bending resistance provided by the slot flanges 56. The slots 52, 54 and the flanges 56, 60 are formed in the plate 50 by a stamping process.

It may now be seen that the arrangement of upper and lower slots 52, 54 in basket 22 defines regions 62 of high bending resistance relative to controlled arch region 64 without the slots 52, 54. In the rest orientation, the basket 22 is substantially flat as is shown in solid outline in FIG. 3. As the cable mechanism 24 is operated to draw the brackets 38, 30 together, the plate 50 flexes outwardly in the direction 66, as shown in phantom outline in FIG. 3. The flexing of the plate 50 is more pronounced in the controlled arch region 64 having relative low bending resistance in order to conform more closely to the curvature of a user's spine.

The bending resistance provided by the slot flanges 56 and edge flanges 60 can be varied according to the flange angle A and the flange length L. The flange angle A may range from 5 degrees to 90 degrees but an angle A of 48 degrees is preferred for the edge flange 60 and an angle A of 80 degrees is preferred for the slot flanges 56. The flange length L may range from 1 millimetre up to 6 millimetres or more but a length L of 2 millimetres is preferred for the edge flanges 60 and a length L of 3.4 millimetres is preferred for the slot flanges 56. In the preferred embodiment the flange angle A and flange length L is uniform over the full extent of the edge flange 60 or slot flange 56. It will be appreciated however that the angle A or length L may be varied over the extent of the flanges 56 or 60 depending upon the bending resistance desired.

Referring to FIGS. 9 to 18, a second embodiment of a shape adjusting mechanism in accordance with the present invention is shown generally at 200.

The mechanism 200 includes a basket 202 and a cable mechanism 204. Similar to the embodiment described above, the cable mechanism 204 has any suitable construction as is known in the art for flexing a basket. The depicted cable mechanism 204 has a rotatable knob 206 that is operably connected to a cable winding assembly 208. The cable winding assembly 208 has a rigid sheath 210 that extends to a point at the rear surface of the basket 202 along an axis 212. A cable 214 extends from a spool (not shown) in the cable winding assembly 208 and attaches by means of a ring 216 to an aperture 218 that is defined in an upper support bracket 220 located on the basket 202. The cable 214 is tensioned in part by a spring 222 that is mounted to a lower support bracket 224 on the basket 202.

The mechanism 200 includes a guide track 240 which consists of a pair of steel rods 242 in general alignment with axis 212. The upper support bracket 220 carries a pair of low friction sleeves 244 that receive the rods 242 of the guide track 240. The lower support bracket 224 is connected to the rods 244. The guide track 240 can be mounted to a common support structure insertable into the back rest or separately mounted within the back rest, as has been done in the prior art.

The knob 206 can be rotated in one direction to draw the cable 214 onto the spool in the cable winding assembly 208 thus displacing the upper and lower support brackets 220, 224 axially towards one another and flexing the basket 202. The knob 206 can be rotated in an opposite direction to release the cable 214 allowing the brackets 220, 224 to separate under the resilience of the basket 202. As well, a mechanism (not shown) will typically be provided to displace the brackets 220, 224 together along the guide track 240 for purposes of positioning the basket 202.

Referring more particularly to the basket 202 as shown in FIGS. 12 to 18, the basket is formed as a one piece plate 250 that is cut from a resiliently flexible lightweight and thin material such as spring steel (e.g. MARTENSITE™).

Figure 16:
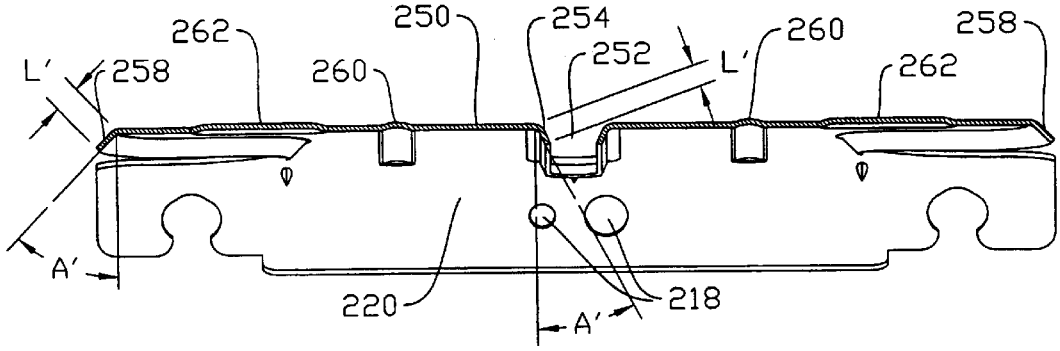
FIG. 16 is a transverse sectional view of the basket of FIG. 12 taken along lines 16—16.
Figure 17:
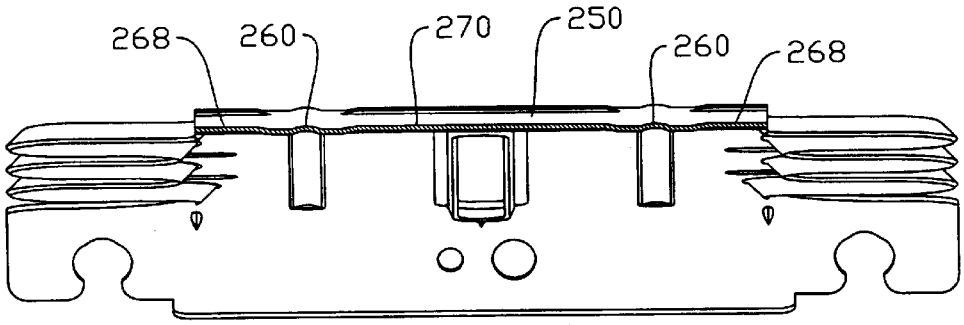
FIG. 17 is a transverse sectional view of the basket of FIG. 12 taken along lines 17—17.
Figure 18:
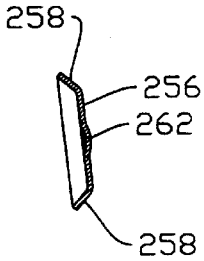
FIG. 18 is a sectional view of a transverse rib of the basket of FIG. 12 taken along lines 18—18.

A slot 252 is defined in the plate 250 along a portion of the axis 212. The slot has rearwardly extending flanges 254 that act to reinforce the slot 252 against bending along axis 212. The slot flanges 254 are preferably inclined towards the centre of the slot 252 as shown in FIG. 16. Two parallel flanges 254 are shown but it will be appreciated that the slot 252 may be defined by a single flange 254.

The basket 202 further includes transverse ribs 256 that are integrally formed with the plate 250 and which extend laterally outwardly relative to the slot 252.

A flange 258 is defined along the peripheral edges of the ribs 256 to provide further resistance against bending along axis 212 as described further below.

A pair of axial stiffening ridges 260 are formed in the plate parallel to the centre axis 212 as known in the art to provide added longitudinal rigidity to the plate 250. The axial stiffening ridges are spaced laterally at equal distances from the axis 212. Individual transverse stiffening ridges 262 are also formed in the plate 250 centrally along each transverse rib 256 to add rigidity to each of the ribs 256 along their transverse axes.

A plurality of elongated depressions called crossforms 264 are formed in the plate 250 in a controlled arch region 266 where it is desired to encourage formation of an arch in the plate in a rest state before the brackets 220, 224 are drawn together. So as not to compromise the rigidity of the axial stiffening ridges 260, the crossforms 264 each have an edge portion 268 that extends from the outer edge of the plate 250 to a point adjacent to but not touching the longitudinal stiffening ridge 260 and a centre portion 270 that extends between the longitudinal stiffening ridges 260 without touching the ridges 260. In an alternate embodiment, where edge flanges 258 are provided in the arch region 266 in place of axial stiffening ridges, the crossforms 264 may extend fully transversely across the basket. However, the crossforms would not extend into the edge flanges 258 as that would compromise the longitudinal rigidity provided by the edge flanges 258.

Figure 15:
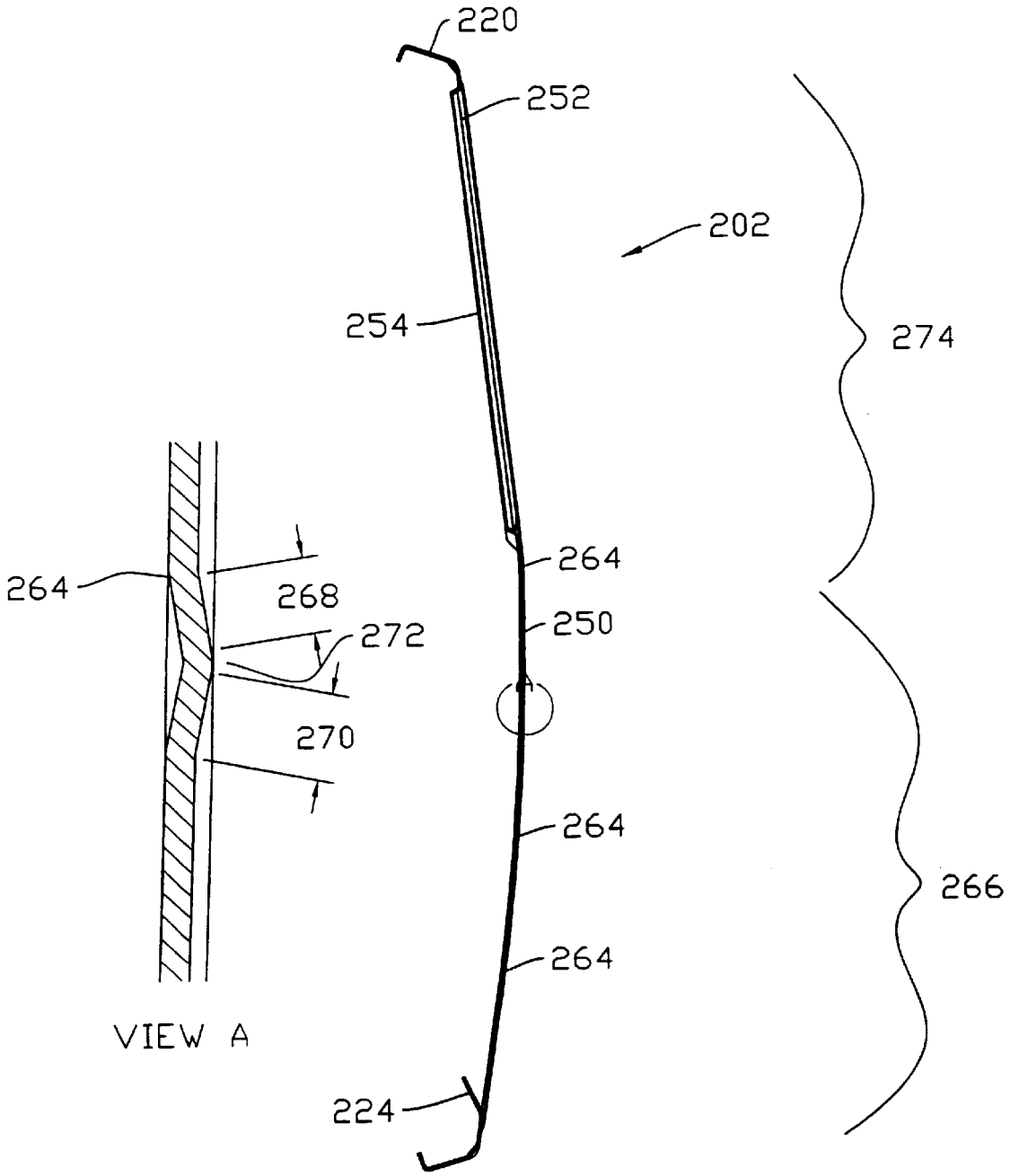
FIG. 15 is a longitudinal sectional view of the basket of FIG. 12 taken along lines 15—15.

The crossforms 264 are rounded in cross section in order to avoid defining a transverse foldline in the basket. As shown in FIG. 15 the crossform 260 is not uniformly formed in the plate but instead has one side 268 that is longer than the other side 270. This results from the step of forming the crossform 260 to define the desired arch height in the arch region 266.

The slot 252, flanges 254, 258 and ridges 260, 262 are formed in the plate 250 by a stamping process with each of the crossforms 264 being formed in a separate step. It is intended that the same process may be performed in future using a progressive die.

It may now be seen that the slot 252 in basket 202 defines a region 274 of high bending resistance relative to controlled arch region 266 in which an arch is preformed. In the rest orientation, the basket 202 is substantially flat over region 274 and arched over controlled arch region 266 as is shown in solid outline in FIG. 11. As the cable mechanism 204 is operated to draw the brackets 220, 224 together, the plate 250 flexes outwardly in the direction 276, as shown in phantom outline in FIG. 11. The flexing of the plate 250 is more pronounced in the controlled arch region 266 having relative low bending resistance in order to conform more closely to the curvature of a user's spine. The predefined arch in the controlled arch 266 ensures that the basket 202 will flex in direction 276 and not in the opposite direction where a snap back risk exists.

As stated for the first embodiment described above, the bending resistance provided by the slot flanges 254 and edge flanges 258 can be varied according to the flange angel A' and flange length L'. The ranges of angles and lengths are the same as for the first embodiment described above.

It is to be understood that what has been described is a preferred embodiment to the invention. The invention nonetheless is susceptible to certain changes and alternative embodiments fully comprehended by the spirit of the invention as described above, and the scope of the claims set out below. For instance, instead of a one-piece basket the basket may be formed with one or more axial plates (or ribs) that extend between upper and lower support brackets. One or more slots with slot flanges may be defined in the axial plates to provide a region of higher bending resistance. Crossforms may also be defined in the axial plates to define a region where an arch is predefined.

What is claimed is:

1. A panel for a shape adjusting mechanism comprising:

at least one elongate resilient plate having at least one elongate slot defined parallel to a first portion of the longitudinal axis of said plate and a controlled arch region defined along a second portion of the longitudinal axis of said plate, the second portion being distinct from the first portion; and at least one reinforcing flange defined along at least one longitudinal side of said at least one slot to define a region of high bending resistance relative to said controlled arch region in said plate in order that the flex of said plate in said controlled arch region will be more pronounced than in the region with said slot.

2. A panel as claimed in claim 1 wherein said at least one reinforcing flange for said slot extends at an angle of between 5 and 90 degrees relative to said plate.

3. A panel as claimed in claim 1 further comprising at least one reinforcing flange defined along at least one longitudinal edge of said plate.

4. A panel as claimed in claim 3 where said reinforcing flange for said longitudinal edge extends at an angle of between 5 and 90 degrees relative to said plate.

5. A panel as claimed in claim 1 further comprising a predefined arch in said controlled arch region of said plate when said plate is in a rest state to ensure that said panel can flex in one direction only when the ends of said panel are displaced axially towards each other.

6. A panel as claimed in claim 5 further comprising at least one elongate depression in said controlled arch region aligned perpendicularly to the axis of said plate to form said predefined arch.

7. A panel as claimed in claim 6 wherein said at least one elongate depression has, in cross section, sides with a difference in length, said difference in length defining the amount of arch predefined by said at least one elongate depression.

8. A shape adjusting mechanism comprising:

a pair of support brackets spaced apart along a predetermined axis;

at least one elongate resilient plate having one end fixed to one of said support brackets and an opposite end fixed to the other of said support brackets such that said plate flexes in a predetermined direction as said support brackets are displaced axially towards one another;

at least one elongate slot defined parallel to a first portion of the longitudinal axis of said plate and a controlled arch region defined along a second portion of the longitudinal axis of said plate, the second portion being distinct from the first portion,wherein said slot has at least one reinforcing flange defined along at least one longitudinal side of said at least one slot to define a region of high bending resistance relative to said controlled arch region in said plate in order that the flex of said plate in said controlled arch region will be more pronounced than in the region with said slot; and means operable to displace said support brackets axially relative to one another thereby to flex said plate.

9. A mechanism as claimed in claim 8 wherein said at least one reinforcing flange for said slot extends at an angle of between 5 and 90 degrees relative to said plate.

10. A mechanism as claimed in claim 8 further comprising at least one reinforcing flange defined along at least one longitudinal edge of said plate.

11. A mechanism as claimed in claim 10 where said reinforcing flange for said longitudinal edge extends at an angle of between 5 and 90 degrees relative to said plate.

12. A mechanism as claimed in claim 8 further comprising a predefined arch in said controlled arch region of said plate when said plate is in a rest state to ensure that said panel can flex in one direction only when the ends of said panel are displaced axially towards each other.

13. A mechanism as claimed in claim 12 further comprising at least one elongate depression in said controlled arch region aligned perpendicularly to the axis of said plate to form said predefined arch.

14. A mechanism as claimed in claim 13 wherein said at least one elongate depression has, in cross section, sides with a difference in length, said difference in length defining the amount of arch predefined by said at least one elongate depression.

* * * * *

UNITED STATES PATENT AND TRADEMARK OFFICE

CERTIFICATE OF CORRECTION

PATENT NO. : 6,296,308 B1
DATED : October 2, 2001
INVENTOR(S) : Cosentino et al.

It is certified that error appears in the above-identified patent and that said Letters Patent is hereby corrected as shown below:

Title page,
Please insert -- Priority Date: February 12, 1999 from Canadian Patent 2,261,876 --

Signed and Sealed this

Ninth Day of April, 2002

*Attest:*

*Attesting Officer*

JAMES E. ROGAN
*Director of the United States Patent and Trademark Office*